US007469900B2

(12) United States Patent
Patelidas

(10) Patent No.: US 7,469,900 B2
(45) Date of Patent: Dec. 30, 2008

(54) 20 CARD DECK POKER GAME AND METHOD THEREFOR

(75) Inventor: Antonio Pantelis Patelidas, Las Vegas, NV (US)

(73) Assignee: New Poker Championships, LLC, Las Vegas, NV (US)

( * ) Notice: Subject to any disclaimer, the term of this patent is extended or adjusted under 35 U.S.C. 154(b) by 0 days.

(21) Appl. No.: 10/890,900

(22) Filed: Jul. 15, 2004

(65) Prior Publication Data

US 2005/0121853 A1 Jun. 9, 2005

Related U.S. Application Data

(60) Provisional application No. 60/527,208, filed on Dec. 4, 2003.

(51) Int. Cl.
*A63F 1/00* (2006.01)

(52) U.S. Cl. ..... 273/292; 273/274; 463/13

(58) Field of Classification Search ..... 273/292, 273/274, 309; 463/12, 13
See application file for complete search history.

(56) References Cited

U.S. PATENT DOCUMENTS

| | | | | |
|---|---|---|---|---|
| 5,669,817 | A * | 9/1997 | Tarantino | 463/13 |
| 5,810,354 | A * | 9/1998 | Banyai | 273/292 |
| 5,868,392 | A * | 2/1999 | Kraft | 273/292 |
| 5,901,958 | A * | 5/1999 | Andrews | 273/292 |
| 5,908,353 | A * | 6/1999 | Andrews | 463/13 |
| 2002/0125639 | A1 * | 9/2002 | Wells | 273/274 |
| 2003/0064767 | A1 * | 4/2003 | Brown | 463/12 |

OTHER PUBLICATIONS www.pokernews.com/poker-variants/shared-card-poker.html.*
"Manila Poker", Gambling Poker.com, http://webarchive.org/web/20030402095010/http://www.gambling-poker.com/manila_poker.html, Apr. 2, 2003.*

* cited by examiner

*Primary Examiner*—Benjamin H Layno
(74) *Attorney, Agent, or Firm*—Harry M. Weiss; Craig Weiss; Weiss & Moy, P.C.

(57) ABSTRACT

A new variation of poker comprising a 20-card deck for use with poker games and a table and method therefor. The 20-card deck comprises the five highest ranked cards of 10, Jack, Queen, King and Ace in each of the four suits of Diamonds, Clubs, Hearts and Spades. The 20-card deck is preferably used in conjunction with Texas Hold'em, but can be used with other poker games as well.

1 Claim, 2 Drawing Sheets

20 CARD DECK POKER GAME AND METHOD THEREFOR

RELATED APPLICATIONS

This patent application is claiming the benefit of the U.S. Provisional Application having an application number of 60/527,208, filed Dec. 4, 2003, in the name of the inventor Antonio Patelidas, and entitled ROYAL HOLD 'EM POKER, and is further related to the Disclosure Document filed with the United States Patent Office by the inventor on Nov. 12, 2003, incorporated herein by reference.

FIELD OF THE INVENTION

This invention relates generally to card games and methods therefor and, more particularly, to a 20 card deck for various poker games and table and method therefor.

BACKGROUND OF THE INVENTION

Card games are popular both socially and for gambling purposes. Poker, and its many variations, is among the most common card games, especially for gambling. The general aim of poker is to collect a five card hand that is superior to the five card hand of one or more opponents or to try to bet in such a way as to cause opponents to believe that their hand is inferior and subsequently "fold" (concede or turn in) their hand. In the game of poker, several players compete against one another for one cumulative "pot" or sum of money. In casinos, the dealer or "house" draws a percentage, otherwise known as "the rake", of each pot, thus generating revenue regardless of which player wins each hand.

In a standard 52-card deck of playing cards, there are 13 separately valued cards, from low to high in rank: 2, 3, 4, 5, 6, 7, 8, 9, 10, jack (J), queen (Q), king (K), and ace (A) (although the ace can sometimes have the value of the lowest card in the deck). Each of the 13 ranked cards comes in four different suits: club, diamond, heart, and spade, with no suit higher than another—for a total of 52 cards.

There are many separate types of games within the poker family (such as Texas Hold'em, Seven-Card Stud, Draw Poker, Hi-low, and Omaha) all of which provide alternative formats for competing over a five card hand. Typically, these games involve a standard 52-card deck, although some variations use multiple decks or add a few cards called jokers which can be used as a substitute for any card in the deck.

Of all the many variations of poker, Texas Hold'em is the arguably the most famous, and perhaps the most popular. However, many poker players find that waiting for a high-quality poker hand is both time-consuming and boring. Attempts have been made to liven up the game in several different ways. Gaming machines, such as video poker machines, allow poker players the ability to play games with greater frequency. In addition, many of these machines offer variations on the game of poker which cannot be found in casino poker rooms, such as the use of multiple decks and jokers. The proliferation of so many different variations of poker and the use of joker cards is a sign that poker player crave change.

Because the poker ranking of a standard 52 card deck places the cards 10, Jack, Queen, King and Ace as the cards having the highest five ranks, poker players have grown accustomed to preferring those cards. Seeing a "face card" (e.g., Jack, Queen or King) or a 10 or an Ace, tends to excite most poker players. However, the majority of cards in a standard 52-card deck are lower in rank than the five highest ranked cards. Therefore, a majority of the time, players receive lower-ranked cards, which contributes to the boredom and staleness of poker.

A need therefore existed for providing a new, exciting variation of poker and table and method therefor that would provide players with a 20-card poker deck comprising only the five highest ranked cards of 10, Jack, Queen, King and Ace in each of the four suits of Diamonds, Clubs, Hearts and Spades. In this way, players will only receive cards which they are typically excited to receive.

SUMMARY OF THE INVENTION

An object of the present invention is to provide an improved poker card game that comprises a 20 card deck having a 10 of Diamonds, 10 of Clubs, 10 of Hearts, 10 of Spades, a Jack of Diamonds, Jack of Clubs, Jack of Hearts, Jack of Spade, Queen of Diamonds, Queen of Clubs, Queen of Hearts, Queen of Spades, King of Diamonds, King of Clubs, King of Hearts, King of Spades, Ace of Diamonds, Ace of Clubs, Ace of Hearts, and Ace of Spades.

It is a further object of the present invention to provide a table and method for using a 20 card deck having a 10 of Diamonds, 10 of Clubs, 10 of Hearts, 10 of Spades, a Jack of Diamonds, Jack of Clubs, Jack of Hearts, Jack of Spade, Queen of Diamonds, Queen of Clubs, Queen of Hearts, Queen of Spades, King of Diamonds, King of Clubs, King of Hearts, King of Spades, Ace of Diamonds, Ace of Clubs, Ace of Hearts, and Ace of Spades.

BRIEF DESCRIPTION OF THE PREFERRED EMBODIMENTS

In accordance with one embodiment of the present invention, a 20 card deck poker game is disclosed, comprising, in combination a first set of four different suited playing cards each having a poker value of a 10, a second set of four different suited playing cards each having a poker value of a Jack, a third set of four different suited playing cards each having a poker value of a Queen, a fourth set of four different suited playing cards each having a poker value of a King, and a fifth set of four different suited playing cards each having a poker value of a Ace.

In accordance with another embodiment of the present invention, a method for playing a card game of poker is disclosed, comprising, in combination, the steps of providing a first set of four different suited playing cards each having a poker value of a 10, providing a second set of four different suited playing cards each having a poker value of a Jack, providing a third set of four different suited playing cards each having a poker value of a Queen, providing a fourth set of four different suited playing cards each having a poker value of a King, providing a fifth set of four different suited playing cards each having a poker value of a Ace, and dealing at least one of the playing cards to at least one player.

In accordance with yet another embodiment of the present invention, a poker-type card game table is disclosed, comprising, in combination a first set of four different suited playing cards each having a poker value of a 10, a second set of four different suited playing cards each having a poker value of a Jack, a third set of four different suited playing cards each having a poker value of a Queen, a fourth set of four different suited playing cards each having a poker value of a King, a fifth set of four different suited playing cards each having a poker value of a Ace, a dealer area, six player hand areas, each player hand area dimensioned to receive two of the playing cards, a discard area dimensioned to receive the playing cards discarded by a dealer, and a center area dimensioned to receive up to five of the playing cards as community cards.

The foregoing and other objects, features, and advantages of the invention will be apparent from the following, more particular description of the preferred embodiments of the invention, as illustrated in the accompanying drawings.

DETAILED DESCRIPTION OF THE PREFERRED EMBODIMENTS

Referring to FIGS. 1A, 1B, 1C and 1D, twenty cards are shown comprising the five highest ranked cards of 10, Jack, Queen, King and Ace in each of the four suits of Diamonds, Clubs, Hearts and Spades. The twenty cards shown in FIGS. 1A-1D comprise the twenty-card deck of the present invention. The twenty-card deck is of the same size and configuration as a standard 52-card deck, but is only shown smaller in FIGS. 1A-1D for purposes of illustration only.

The twenty-card deck shown in FIGS. 1A-1D can be used to achieve standard poker hands, such as a straight. For example, in a standard 52-card deck, one possible five card poker hand is a "straight," which is five cards in order, regardless of suit. A straight is still possible with the twenty-card deck shown in FIGS. 1A-1D, by receiving a hand of A-K-Q-J-10.

One of the advantages to the twenty-card deck of the present invention is the ability to more frequently achieve rare poker hands, such as a royal flush. The highest ranked poker hand, a royal flush, is comprised of the five highest ranked cards in order and of the same suit (e.g., A-K-Q-J-10 of Hearts). A poker hand of a royal flush is much more likely to occur in the twenty-card deck of the present invention than in a standard 52-card deck. In fact, any flush must be a royal flush when using the twenty-card deck of the present invention. As a result, the twenty-card deck of the present invention provides poker players with the opportunity to consistently achieve poker hands of a very high rank.

The new 20-card deck of the present invention could be put in use with any of the standard poker variations, such as Draw Poker, Seven-Card Stud, Texas Hold'em, Omaha, Caribbean Poker, Pai Gow Poker, and the like. In the preferred embodiment, the twenty-card deck of the present invention is used to play Texas Hold'em, although it should be clearly understood that substantial benefit could be derived from an alternative configuration of the present invention in which the twenty-card deck of the present invention is used with another poker game, even one not included in the aforementioned list of poker games. Additionally, the 20-card deck of the present invention could be used in any of the standard poker variations in table games as well as video poker gaming machines.

Figure 1:
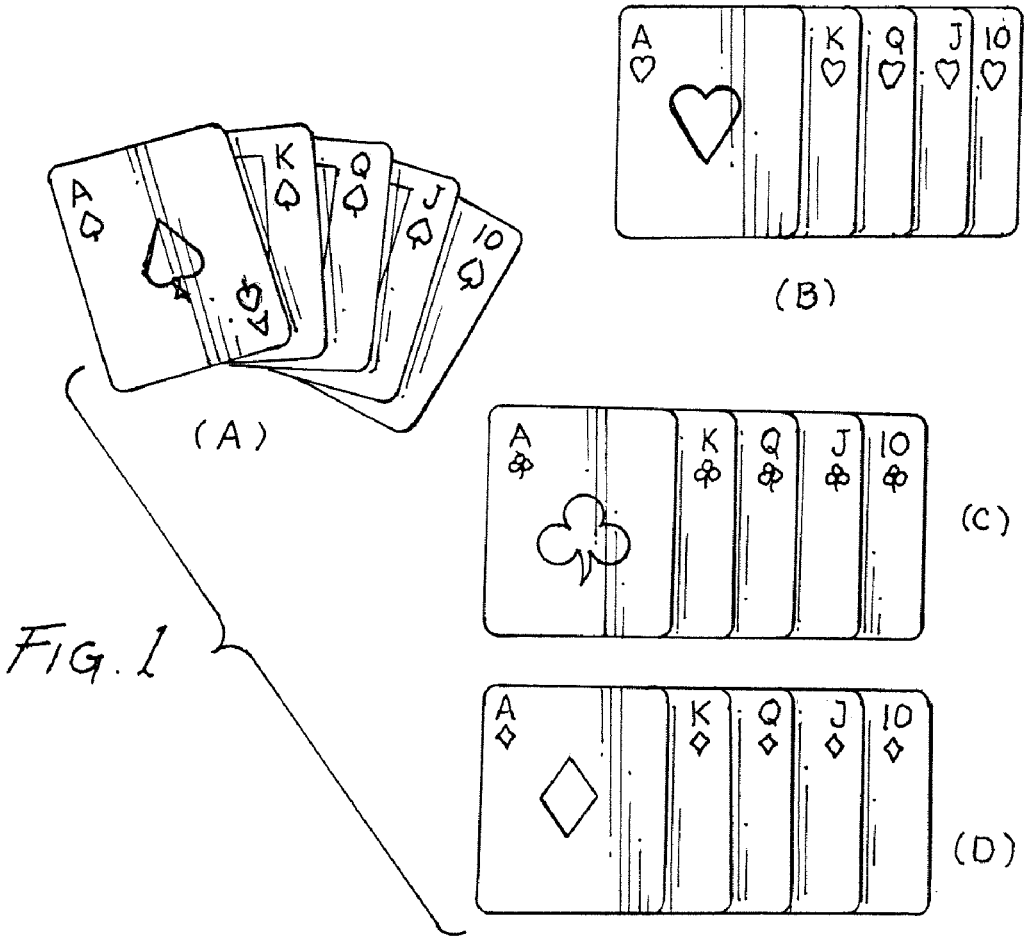
FIG. 1 is a top view of the 20 card deck poker game of the present invention showing: an Ace, King, Queen, Jack and 10 of Spades (FIG. 1A); an Ace, King, Queen, Jack and 10 of Hearts (FIG. 1B); an Ace, King, Queen, Jack and 10 of Clubs (FIG. 1C); and an Ace, King, Queen, Jack and 10 of Diamonds (FIG. 1D).
Figure 2:
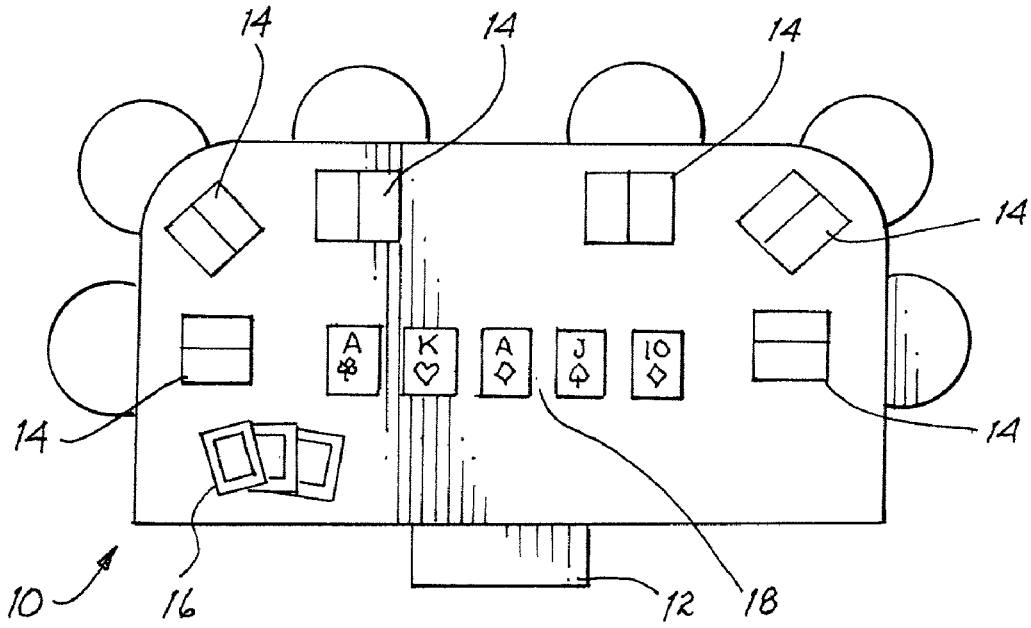
FIG. 2 is a top view of the poker-type card game table used in conjunction with the preferred embodiment of the 20-card deck of the present invention.

Referring now to FIG. 2, a poker-type card game table, hereinafter poker-type card game table 10, is shown. The poker-type card game table 10 is for use with the 20-card deck of the present invention. The poker-type card game table 10 comprises a dealer area 12, six player hand areas 14 dimensioned to receive two of the playing cards of the 20-card deck of the present invention, a discard area 16 dimensioned to receive the playing cards discarded by the dealer and a center area 18 dimensioned to receive up to five community cards. Preferably, the poker-type card game table 10 is for use with the poker game Texas Hold'em. In Texas Hold'em, each player receives 2 cards. With six players, five community cards and three burn cards, all twenty cards of the twenty-card deck are utilized, however, it should be clearly understood that substantial benefit could be derived from adding seventh player hand area 14 dimensioned to receive two playing cards, and eliminating the discard area 16 (or limiting the discard area 16 to receiving only one card).

Figure 3:
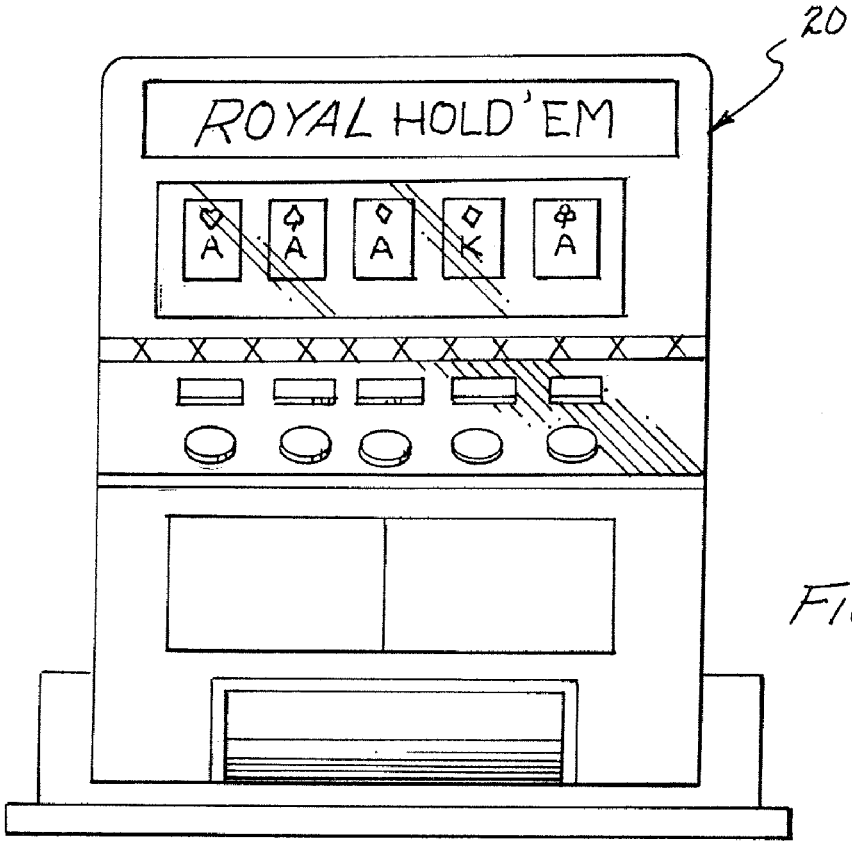
FIG. 3 is a front view of a video poker gaming machine for use with the 20 card deck of the present invention.

Referring now to FIG. 3, a video gaming machine 20 is shown for use with the 20-card deck of the present invention. The 20-card deck of the present invention may be used by a video gaming machine similar to standard video poker gaming machines. In the video gaming machines which use more than one regular 52-card deck, more than one 20-card deck may be used in the same way. In the preferred embodiment, a player playing Texas Hold'em with a 20-card deck on a video poker machine can draw two cards for each hand of Texas Hold'em dealt. A new variation of video poker involves "triple play," which allows a player to be dealt three draw poker hands simultaneously. Preferably, the 20 card deck can also be used by such triple play video poker machines.

In the realm of video poker gaming machines, bonus awards are often awarded to a player for receiving a hand of a certain predetermined value. Preferably, using a 20-card deck, video poker machines could similarly offer players a bonus award for receiving a poker hand of a predetermined value.

While the invention has been particularly shown and described with reference to preferred embodiments thereof, it will be understood by those skilled in the art that the foregoing and other changes in form and details may be made therein without departing from the spirit and scope of the invention.

I claim:

1. A method of playing a Texas Hold'em poker card game comprising, in combination, the steps of:

providing a deck consisting of only twenty playing cards having only the highest playing cards of 10s, Jacks, Queens, Kings and Aces further comprising the steps of:

providing a first set of four different suited playing cards each having a poker value of a 10;

providing a second set of four different suited playing cards each having a poker value of a Jack;

providing a third set of four different suited playing cards each having a poker value of a Queen;

providing a fourth set of four different suited playing cards each having a poker value of a King;

providing a fifth set of four different suited playing cards each having a poker value of an Ace, said first set, said second set, said third set, said fourth set and said fifth set being at least one of physical and virtual and providing a total of said twenty playing cards for said Texas Hold'em poker card game;

dealing two cards from said total of twenty playing cards face down to each player of a maximum of only six players to provide each player with only high valued playing cards having a poker value ranging from a poker value of 10 as a lowest poker value to a poker value of an Ace as a highest poker value; and dealing five community cards face up from remaining playing cards from said total of twenty playing cards to provide all of said players five community high valued playing cards having a poker value ranging from a poker value of 10 as a lowest poker value to a poker value of an Ace as a highest poker value;

said five community high valued playing cards are dealt face up by the steps of burning one card having a poker value ranging from a poker value of 10 as a lowest poker value to a poker value of an Ace as a highest poker value before a three card flop of said five community high valued cards each having a poker value ranging from a poker value of 10 as a lowest poker value to a poker value of an Ace as a highest poker value is played so that no player has a poker hand value of less than one pair;

burning a second card having a poker value ranging from a poker value of 10 as a lowest poker value to a poker value of an Ace as a highest poker value before a high valued turn card having a poker value ranging from a poker value of 10 as a lowest poker value to a poker value of an Ace as a highest poker value of said five community high valued cards is played so that no player has a poker hand value of less than two pair;

burning a third card having a poker value ranging from a poker value of 10 as a lowest poker value to a poker value of an Ace as a highest poker value before a high valued river card having a poker value ranging from a poker value of 10 as a lowest poker value to a poker value of an Ace as a highest poker value of said five community high valued cards having a poker value ranging from a poker value of 10 as a lowest poker value to a poker value of an Ace as a highest poker value is played; and providing each player after dealing said two cards face down to each player, after dealing said five community cards face up for use by each player, and after the steps of burning said one card before the three card flop of said five community cards, after burning said second card before the said turn card of said five community cards is exposed and after burning said third card before the said river card of said five community cards is exposed, a total of seven cards which includes said two cards dealt face down and said five community cards dealt face up from only the said highest playing cards of 10s, Jacks, Queens, Kings and Aces.

* * * * *